US010652673B2

(12) United States Patent
Pedersen et al.

(10) Patent No.: US 10,652,673 B2
(45) Date of Patent: May 12, 2020

(54) HEARING INSTRUMENT WITH AN AUTHENTICATION PROTOCOL

(71) Applicant: GN Hearing A/S, Ballerup (DK)

(72) Inventors: Brian Dam Pedersen, Ringsted (DK); Peter Siegumfeldt, Frederiksberg (DK); Hans Henrik Bjoerstrup, Vaerloese (DK)

(73) Assignee: GN Hearing A/S, Ballerup (DK)

( * ) Notice: Subject to any disclaimer, the term of this patent is extended or adjusted under 35 U.S.C. 154(b) by 146 days.

(21) Appl. No.: 13/896,256

(22) Filed: May 16, 2013

(65) Prior Publication Data

US 2014/0341405 A1 Nov. 20, 2014

(30) Foreign Application Priority Data

May 15, 2013 (DK) ..... 2013 70266
May 15, 2013 (EP) ..... 13167842

(51) Int. Cl.

| | |
|---|---|
| ***H04R 25/00*** | (2006.01) |
| ***H04H 60/16*** | (2008.01) |
| ***H04H 60/44*** | (2008.01) |
| ***H04H 20/61*** | (2008.01) |

(52) U.S. Cl.

CPC ..... *H04R 25/554* (2013.01); *H04H 60/16* (2013.01); *H04H 60/44* (2013.01); *H04H 20/61* (2013.01); *H04R 2225/41* (2013.01); *H04R 2225/61* (2013.01)

(58) Field of Classification Search

CPC .. H04R 25/00; H04R 25/554; H04R 2225/41; H04R 2225/61; H04H 40/18; H04H 60/16; H04H 60/44; H04H 20/61

USPC ..... 381/315

See application file for complete search history.

(56) References Cited

U.S. PATENT DOCUMENTS 6,373,791 B1 4/2002 Ukita et al.
6,611,913 B1 * 8/2003 Carroll ..... H04L 9/0894 455/410
7,343,317 B2 * 3/2008 Jokinen ..... G06Q 30/02 370/328
7,827,289 B2 * 11/2010 Bucher ..... G06F 21/10 709/227

(Continued)

FOREIGN PATENT DOCUMENTS

CN 101552668 A 10/2009
CN 102164016 A 8/2011

(Continued)

OTHER PUBLICATIONS

First Technical Examination and Search Report dated Sep. 12, 2013, for related Danish Patent Application No. PA 2013 70266, 5 pages.

(Continued)

*Primary Examiner* — Sean H Nguyen

(74) *Attorney, Agent, or Firm* — Vista IP Law Group, LLP

(57) ABSTRACT

A hearing instrument includes: a radio for reception of a broadcasted message; an authenticator configured for authentication of a transmitter of the broadcasted message; and a receiver configured for converting the broadcasted message into an acoustic signal for transmission towards an eardrum of a user of the hearing instrument upon successful authentication of the transmitter of the broadcasted message.

32 Claims, 3 Drawing Sheets

(56) References Cited

U.S. PATENT DOCUMENTS

| | | | | |
|---|---|---|---|---|
| 2003/0229900 | A1* | 12/2003 | Reisman | G06F 17/30873 725/87 |
| 2004/0110522 | A1* | 6/2004 | Howard et al. | 455/512 |
| 2006/0274747 | A1 | 12/2006 | Duchscher et al. | |
| 2008/0059993 | A1* | 3/2008 | Jia | H04N 7/1675 725/31 |
| 2008/0258871 | A1* | 10/2008 | Waldmann | 340/7.51 |
| 2008/0311966 | A1* | 12/2008 | Klein | 455/575.2 |
| 2009/0015370 | A1 | 1/2009 | Rowse | |
| 2009/0290522 | A1* | 11/2009 | Zhou | H04L 12/185 370/312 |
| 2010/0293227 | A1 | 11/2010 | Hasler et al. | |
| 2011/0150249 | A1 | 6/2011 | Klemmensen | |
| 2011/0238997 | A1 | 9/2011 | Bellur et al. | |
| 2012/0224732 | A1* | 9/2012 | Secall et al. | 381/315 |
| 2012/0300958 | A1 | 11/2012 | Klemmensen | |
| 2013/0052943 | A1* | 2/2013 | Black | 455/11.1 |
| 2015/0280925 | A1* | 10/2015 | Itou | H04W 12/06 370/338 |

FOREIGN PATENT DOCUMENTS

| | | | | |
|---|---|---|---|---|
| CN | 102739291 | A | 10/2012 | |
| EP | 1681826 | A1 * | 7/2006 | H04L 12/1886 |
| EP | 2 337 377 | A1 | 6/2011 | |
| EP | 2 528 358 | A1 | 11/2012 | |
| JP | 2001-197019 | A | 7/2001 | |
| JP | 2004-364245 | A | 12/2004 | |
| WO | WO 2011/027004 | A2 | 3/2011 | |

OTHER PUBLICATIONS

Extended European Search Report dated Nov. 6, 2013, for related European Patent Application No. 13167842.7, 5 pages.

Second Technical Examination dated Sep. 17, 2014, for corresponding Danish Patent Application No. PA 2013 70266, 3 pages.

Third Technical Examination dated Apr. 10, 2015, for corresponding Danish Patent Application No. PA 2013 70266, 2 pages.

Fourth Technical Examination—Intention to Grant dated May 18, 2015, for corresponding Danish Patent Application No. PA 2013 70266, 2 pages.

Notification of Reasons for Rejection dated Jun. 7, 2016 for corresponding Japanese Patent Application No. 2014-100754, 11 pages.

TOiNX website, http://www.toinx.co.jp/company/information/H24/h25-02-21/ May 27, 2016, 5 pages.

Notification of First Office Action dated Jun. 20, 2017 for corresponding Chinese Patent Application No. 201410242451.6, 21 pages.

European Communication dated Aug. 31, 2017 for corresponding EP Patent Application No. 13167842.7, 7 pages.

Second Chinese Office Action and English Translation, dated Mar. 8, 2018, for corresponding Chinese Patent Application No. 201410242451.6, 25 pages.

* cited by examiner

HEARING INSTRUMENT WITH AN AUTHENTICATION PROTOCOL

RELATED APPLICATION DATA

This Application claims priority to, and the benefit of, European Patent Application No. 13167842.7, filed on May 15, 2013, and Danish Patent Application No. PA 2013 70266, filed on May 15, 2013. The entire disclosures of both of the above applications are expressly incorporated by reference herein.

FIELD OF TECHNOLOGY

A new hearing instrument is provided with a receiver configured for reception of a broadcasted message and an authenticator configured for authentication of the transmitter of the broadcasted message, and wherein the new hearing instrument is further configured for converting the broadcasted message into an acoustic signal for transmission towards an eardrum of a user of the new hearing instrument upon successful authentication of the transmitter of the broadcasted message.

BACKGROUND

Recently hearing aids have emerged that are capable of presenting sound received from various sources to a user of the hearing aid. Examples of sources include mobile phones, radios, media players, companion microphones, broadcasting systems, e.g. used in a public place, e.g. in a church, an auditorium, a theatre, a cinema, etc., public address systems, e.g. used in a railway station, an airport, a shopping mall, etc., etc.

For example, it is well known to use a telecoil to magnetically pick up audio signals generated, e.g., by telephones, FM systems (with neck loops), and induction loop systems (also called "hearing loops"), whereby sound may be transmitted to hearing aids with a high signal to noise ratio. More recently, hearing aids have been equipped with radio circuits for reception of radio signals, e.g. replacing or supplementing telecoils, for reception of streamed audio in general, such as streamed music and speech from media players, such as MP3-players, TV-sets, etc. Hearing aids have also emerged that connect with various sources of audio signals through a short-range network, e.g. including Bluetooth technology, e.g. to interconnect the hearing aid with cellular phones, audio headsets, computer laptops, personal digital assistants, digital cameras, etc. Other radio networks have also been suggested, namely HomeRF, DECT, PHS, Wireless LAN (WLAN), or other proprietary networks.

SUMMARY

In some situations, for example in a public place, it is desirable for a user wearing a hearing instrument to be able to listen to broadcasted messages, such as public announcements, e.g. train, ship or flight departures or delays, with certainty that the transmitter of the broadcasted messages is authentic.

Thus, there is a need for a hearing instrument capable of authentication of a transmitter of broadcasted messages.

Accordingly, a new hearing instrument is provided comprising a radio for reception of a broadcasted message, and an authenticator configured for authentication of a transmitter of the broadcasted message. The hearing instrument is configured for converting the broadcasted message into an acoustic signal for transmission towards an eardrum of a user of the hearing instrument upon successful authentication of the transmitter of the broadcasted message.

A method of authenticating broadcasted messages is also provided, comprising the steps of:

generating a signature, e.g. by encryption, identifying a transmitter of a message to be broadcasted by the transmitter, transmitting the signature together with the message, In a device receiving the broadcasted message; authenticating the transmitter of the broadcasted message based on the transmitted signature, converting the broadcasted message into an acoustic signal for transmission towards an eardrum of a human upon successful authentication of the transmitter of the broadcasted message.

Further, a broadcasting system is provided, comprising a transmitter configured for broadcasting a message to a plurality of receivers, comprising an encoder configured for encoding a signature identifying the transmitter for transmission together with messages to be broadcasted, and a hearing instrument comprising a radio for reception of the broadcasted message, an authenticator configured for authentication of the transmitter of the broadcasted message, and wherein the hearing instrument is further configured for converting the broadcasted message into an acoustic signal for transmission towards an eardrum of a user of the hearing instrument upon successful authentication of the transmitter of the broadcasted message.

The hearing instrument may be a hearing aid, such as a BTE, RIE, ITE, ITC, CIC, etc, a binaural hearing aid; an Ear-Hook, In-Ear, On-Ear, Over-the-Ear, Behind-the-Neck, Helmet, Headguard, etc, headset, headphone, earphone, ear defender, earmuff, etc.

The broadcasted message may be a text message that is converted into speech in the hearing instrument. Preferably, the broadcasted message is a spoken message.

Throughout the present disclosure a broadcasted message is a message that can be received by a plurality of receivers in any form it may take from generation of the message, e.g. the acoustic output from a human making an announcement, to transmission towards an eardrum of a user of the hearing, including the digitized message in a form suitable for wireless transmission and in a form suitable for signal processing in the hearing instrument.

The hearing instrument may be configured for muting at least one other signal received by the hearing instrument, for example the signal from the microphone(s) of the hearing instrument, during transmission of the broadcasted message towards the eardrum of the user of the hearing instrument, upon successful authentication of the transmitter of the broadcasted message. In this way, the user is allowed to concentrate on announcements while possible distractions are reduced.

The hearing instrument may be configured for ignoring the broadcasted message upon failed authentication of the transmitter of the broadcasted message, so that the hearing instrument user will not be bothered with messages from unauthorized transmitters.

The hearing instrument may have a mixer with an input connected to an output of the radio receiving the broadcasted message and other inputs connected to other transmitters of audio signals, such as microphone(s) of the hearing instrument, and an output providing an audio signal that is a weighted combination of the audio signals input to the mixer.

In the mixer, muting may be performed by setting the weights of other signals than the broadcasted message to zero.

In the mixer, ignoring messages from unauthorized transmitters may be performed by setting the weight of the broadcasted message to zero.

In the event that the authenticator does successfully authenticate the transmitter of the broadcasted message, the hearing instrument may be configured to adjust the weights of the mixer so that other signals currently transmitted to the user are attenuated during transmission of the broadcasted message to the user so that the broadcasted message can be clearly heard by the user without the user simultaneously loosing connection with other signals received by the hearing instrument. For example, attenuation of acoustic signals from the surroundings of the user received by a microphone of the hearing instrument during transmission of the broadcasted message, allows the user to stay connected with the surroundings while simultaneously listening to the broadcasted message.

The hearing instrument may simultaneously receive more than one authenticated broadcasted message; i.e. one or more broadcasted messages may be received during ongoing reception of a previous broadcasted message, whereby more than one authenticated broadcasted message may overlap fully or partly in time.

Such a situation may be handled in various ways. For example, broadcasted messages may have assigned priorities and may be transmitted together with information on the priority, e.g. an integer, e.g. larger than or equal to 1, e.g. the lower the integer, the higher the priority. Alarm messages may for example have the highest priority, while traffic announcements may have the second highest priority, and possible commercials may have the lowest priority.

Successfully authenticated broadcasted messages may be presented to the hearing instrument user one at the time in their order of priority, e.g. an authenticated broadcasted message of highest priority may be transmitted to the hearing instrument user without delay, while other broadcasted messages are stored intermediately for subsequent presentation to the hearing instrument user in their order of priority.

Alternatively, successfully authenticated broadcasted messages may be presented to the hearing instrument user one at the time in the same order in which they have been received by the hearing instrument.

Alternatively, successfully authenticated broadcasted messages may be transmitted to the user of the hearing instrument with substantially unchanged timing with relation to each other. The mixer may treat each individual successfully authenticated broadcasted message as a separate input to the mixer similar to other audio transmitters input to the mixer as explained above. The individual successfully authenticated broadcasted messages may be weighted in the mixer, e.g. according to their priority.

The hearing instrument may be configured to always mute one or more other signals received by the hearing instrument during transmission of a broadcasted message of highest priority towards the eardrum of the user of the hearing instrument.

The hearing instrument may have a user interface, e.g. a push button, a remote control, etc. so that the user can switch muting of other signals on and off as desired in order to be able to or not be able to, respectively, continue to listen to other sound signals while receiving a broadcast, as desired.

The user interface may further include means for user adjustment of the weights of the combination of the input audio signals, such as a dial, or a push button for incremental adjustment.

In order for the hearing instrument to be able to authenticate the transmitter of a broadcasted message, an electronic signature uniquely identifying the transmitter of the broadcasted message may be included in the broadcasted message.

Preferably, the electronic signature is encrypted for secure authentication of the transmitter of the broadcasted message.

The electronic signature may include a digital certificate issued by a certificate authority.

The electronic signature may include a hash code, such as a message authentication code, in order for the hearing instrument to be able to authenticate the transmitter of the broadcasted message in a cryptographically simple way.

Signal processing in the new hearing instrument may be performed by dedicated hardware or may be performed in one or more signal processors, or performed in a combination of dedicated hardware and one or more signal processors.

As used herein, the terms "processor", "signal processor", etc., are intended to refer to CPU-related entities, either hardware, a combination of hardware and software, software, or software in execution. Also, the term "processor" may refer to any integrated circuit configured to perform one or more functions.

For example, a "processor", "signal processor", etc., may be, but is not limited to being, a process running on a processor, a processor, an object, an executable file, a thread of execution, and/or a program.

By way of illustration, the terms "processor", "signal processor", etc., designate both an application running on a processor and a hardware processor. One or more "processors", "signal processors", and the like, or any combination hereof, may reside within a process and/or thread of execution, and one or more "processors", "signal processors", etc., or any combination hereof, may be localized on one hardware processor, possibly in combination with other hardware circuitry, and/or distributed between two or more hardware processors, possibly in combination with other hardware circuitry.

A hearing instrument includes: a radio for reception of a broadcasted message; an authenticator configured for authentication of a transmitter of the broadcasted message; and a receiver configured for converting the broadcasted message into an acoustic signal for transmission towards an eardrum of a user of the hearing instrument upon successful authentication of the transmitter of the broadcasted message.

Optionally, the hearing instrument is further configured for muting at least one other signal received by the hearing instrument upon successful authentication of the transmitter of the broadcasted message Optionally, the hearing instrument further includes a mixer configured for mixing the broadcasted message with at least one other signal received by the hearing instrument to obtain a mixed output upon successful authentication of the transmitter of the broadcasted message, wherein receiver is configured for converting the mixed output into the acoustic signal for transmission towards the eardrum of the user of the hearing instrument.

Optionally, the hearing instrument is further configured for ignoring the broadcasted message upon failed authentication of the transmitter of the broadcasted message.

Optionally, the hearing instrument further includes a mixer configured for mixing the broadcasted message and one or more additional broadcasted messages to obtain a mixed output upon successful authentication of the transmitter of the broadcasted message and transmitter(s) of the one or more additional broadcasted messages, wherein the broadcasted message and a subset of the one or more additional broadcasted messages are received simultaneously by the hearing instrument, and wherein the receiver is configured for converting the mixed output into the acoustic signal for transmission towards the eardrum of the user of the hearing instrument.

Optionally, the hearing instrument further includes a medium for storing another broadcasted message that is received during transmission of the acoustic signal towards the eardrum of the user of the hearing instrument.

Optionally, the receiver is configured for converting the stored broadcasted message into another acoustic signal for transmission towards the eardrum of the user of the hearing instrument.

Optionally, the broadcasted message and the other broadcasted message are converted into the respective acoustic signals for transmission towards the eardrum of the user of the hearing instrument in an order in which they are received by the hearing instrument.

Optionally, the broadcasted message and the other broadcasted message are converted into the respective acoustic signals for transmission towards the eardrum of the user of the hearing instrument in an order of priority.

Optionally, the authenticator is further configured for verifying an electronic signature included in the broadcasted message.

Optionally, the authenticator is further configured for decrypting an encrypted message included in the broadcasted message for authentication of the transmitter of the broadcasted message.

Optionally, the authenticator is further configured for decoding a hash code included in the broadcasted message for authentication of the transmitter of the broadcasted message.

A method performed by a hearing instrument includes: receiving a broadcasted message and a signature, wherein the signature identifies a transmitter of the broadcasted message; authenticating the transmitter of the broadcasted message based on the signature; and converting the broadcasted message into an acoustic signal for transmission towards an eardrum of a human upon successful authentication of the transmitter of the broadcasted message.

Optionally, the signature is encrypted when received by the hearing instrument, and the act of authenticating comprises decrypting the encrypted signature.

A broadcasting system includes: a transmitter configured for broadcasting a message, the transmitter comprising an encoder configured for encoding a signature identifying the transmitter for transmission together with message to be broadcasted, and a hearing instrument comprising: a radio for reception of the broadcasted message, and an authenticator configured for authentication of the transmitter of the broadcasted message, wherein the hearing instrument is configured for converting the broadcasted message into an acoustic signal for transmission towards an eardrum of a user of the hearing instrument upon successful authentication of the transmitter of the broadcasted message.

Other and further aspects and features will be evident from reading the following detailed description.

BRIEF DESCRIPTION OF THE DRAWINGS

The drawings illustrate the design and utility of various features described herein, in which similar elements are referred to by common reference numerals. These drawings are not necessarily drawn to scale. In order to better appreciate how the above-recited and other advantages and objects are obtained, a more particular description will be rendered, which are illustrated in the accompanying drawings. These drawings depict only exemplary features and are not therefore to be considered limiting in the scope of the claims.

DETAILED DESCRIPTION

Figure 1:
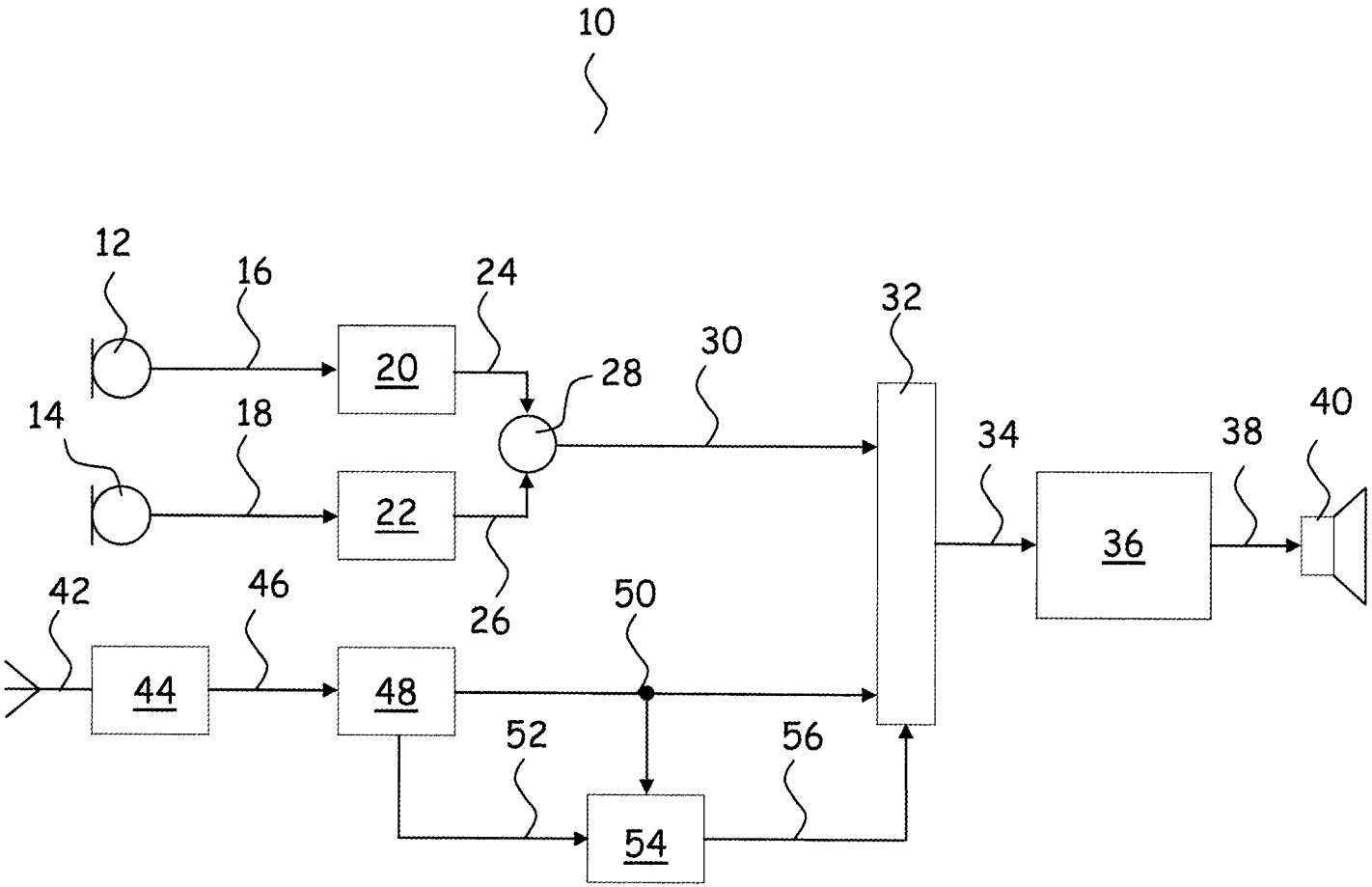
FIG. 1 schematically illustrates electronic circuitry of the new hearing instrument, FIG. 2 schematically illustrates operation of the authenticator utilizing message authentication codes, and FIG. 3 schematically illustrates operation of the authenticator utilizing digital certificates.

Various features are described hereinafter with reference to the figures. It should be noted that the figures are not drawn to scale and that the elements of similar structures or functions are represented by like reference numerals throughout the figures. It should be noted that the figures are only intended to facilitate the description of the features. They are not intended as an exhaustive description of the claimed invention or as a limitation on the scope of the claimed invention. In addition, an illustrated feature needs not have all the aspects or advantages shown. An aspect or an advantage described in conjunction with a particular feature is not necessarily limited to that feature and can be practiced in any other features even if not so illustrated, or if not so explicitly described.

The new method and hearing instrument will now be described more fully hereinafter with reference to the accompanying drawings, in which various examples of the new method and hearing instrument are illustrated. The new method and hearing instrument according to the appended claims may, however, be embodied in different forms and should not be construed as limited to the examples set forth herein.

It should be noted that the accompanying drawings are schematic and simplified for clarity, and they merely show details which are essential to the understanding of the new method and hearing instrument, while other details have been left out.

Like reference numerals refer to like elements throughout. Like elements will, thus, not be described in detail with respect to the description of each figure.

FIG. 1 schematically illustrates exemplary hearing instrument circuitry 10 of the new hearing instrument. The illustrated new hearing instrument is a hearing aid that may be of any suitable mechanical design, e.g. to be worn in the ear canal, or partly in the ear canal, behind the ear or in the concha, such as the well-known types: BTE, ITE, ITC, CIC, etc.

The illustrated hearing instrument circuitry 10 comprises a front microphone 12 and a rear microphone 14 for conversion of an acoustic sound signal from the surroundings into corresponding microphone audio signals 16, 18 output by the microphones 14, 16. The microphone audio signals 16, 18 are digitized in respective A/D converters 20, 22 for conversion of the respective microphone audio signals 16, 18 into respective digital microphone audio signals 24, 26 that are optionally pre-filtered (pre-filters not shown) and combined in signal combiner 28, for example for formation of a digital microphone audio signal 30 with directionality as is well-known in the art of hearing instruments. The digital microphone audio signal 30 is input to the mixer 32 configured to output a weighted sum 34 of signals input to the mixer 32. The mixer output 34 is input to a hearing loss processor 36 configured to generate a hearing loss compensated output signal 38 based on the mixer output 34. The hearing loss compensated output signal 38 is input to a receiver 40 for conversion into acoustic sound for transmission towards an eardrum (not shown) of a user of the hearing instrument.

The illustrated hearing instrument circuitry 10 is further configured to receive digital audio from various transmitters, such as mobile phones, radios, media players, companion microphones, broadcasting systems, such as in a public place, e.g. in a church, an auditorium, a theatre, a cinema, etc., public address systems, such as in a railway station, an airport, a shopping mall, etc., etc.

In the illustrated example, digital audio, including broadcasted spoken messages, is transmitted wirelessly to the hearing instrument and received by the hearing instrument antenna 42 connected to a radio receiver 44. The radio receiver retrieves the digital data 46 from the received radio signal, including the digital audio, possible transmitter identifiers, possible network control signals, etc. Signal extractor 48 extracts the digital audio 50 from the received digital data 46 and forwards the digital audio 50 to the mixer 32. The digital audio 50 may include audio from a plurality of sources and thus, the digital audio 50 may form a plurality of input signals for the mixer 32, one input signal for each source of audio.

As further explained below, digital data of the broadcasted message also contains data 52 relating to the identity of the transmitter of the broadcasted message. The signal extractor 48 extracts these data 52 from the digital data and forwards them to authenticator 54 that is configured to authenticate the transmitter of the broadcasted message as will be further explained below. Output authentication signal 56 forms a control input to the mixer 32 for control of the weights of the sum of mixer input signals.

In the event that the transmitter of the broadcasted message cannot be authenticated, the corresponding weight is set to zero in the mixer 32 so that the broadcasted message 62 is not transmitted to the user; rather the broadcasted message 62 is ignored.

In the event that the transmitter of the broadcasted message is authenticated, the broadcasted message is transmitted to the user while the other signals are attenuated during transmission of the broadcasted message. The other signals may also be muted. The user may enter a command through a user interface of the hearing instrument of a type well-known in the art, controlling whether the other signals are muted or attenuated.

The hearing instrument may simultaneously receive more than one authenticated broadcasted message; i.e. one or more broadcasted messages may be received during ongoing reception of a previous broadcasted message, whereby more than one authenticated broadcasted message may overlap fully or partly in time.

Such a situation may be handled in various ways. For example, broadcasted messages may have assigned priorities and may be transmitted together with information on the priority, e.g. an integer, e.g. larger than or equal to 1, e.g. the lower the integer, the higher the priority. Alarm messages may for example have the highest priority, while traffic announcements may have the second highest priority, and possible commercials may have the lowest priority.

Successfully authenticated broadcasted messages may be handled by the mixer 32 as separate inputs like the other inputs to the mixer, whereby the mixer includes the individual broadcasted messages in the weighted sum of inputs output to the processor 36, whereby the broadcasted messages are transmitted to the user with substantially unchanged timing with relation to each other.

Alternatively, successfully authenticated broadcasted messages may be transmitted to the hearing instrument user one at the time.

The mixer 32 may have one or more media (e.g., one or more memories) for storage of broadcasted messages received during ongoing reception of a previous broadcasted message. A medium may be a non-transitory medium in some embodiments. Stored broadcasted messages may then be input to the mixer subsequent to finalized output of the previous broadcasted message of the mixer 32 in the same order in which they have been received by the hearing instrument; or, in order of priority, for inclusion in the output of the mixer 32 provided that the broadcasted message in question is successfully authenticated.

The hearing instrument may be configured to always mute one or more other signals received by the hearing instrument during transmission of a broadcasted message of highest priority towards the eardrum of the user of the hearing instrument.

Figure 2:
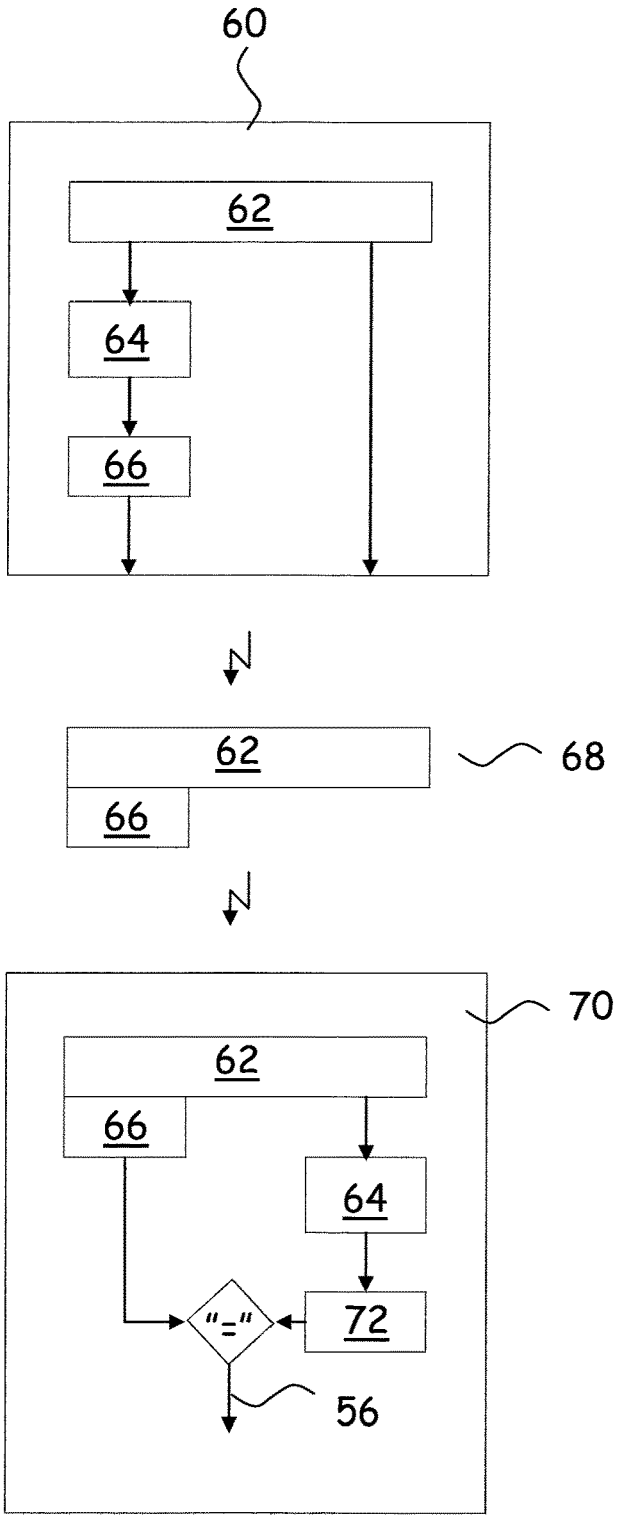

FIG. 2 illustrates exemplary principles of operation of the authenticator 54 shown in FIG. 1. The transmitter 60 of broadcasted messages 62 may emit aural messages, such as departure announcements in an airport. The broadcasted message 62 is transmitted wirelessly and in digital form to a plurality of receivers. The message 62 is illustrated in digital form in FIG. 2. A message authentication algorithm 64 is used to calculate a message authentication code (MAC) 66 from the digitized message 62 in order to authenticate the transmitter 60 of the message 62 and thereby reduce the risk of spoofing. The MAC algorithm 64 implements a cryptographic hash function having a private key as one input and a message of arbitrary length as another input. The MAC algorithm 64 outputs a MAC 66, for example as specified in the various existing standards, such as ISO/IEC 9797-1 and -2 that define MAC algorithms.

The message 62 and the MAC 66 are then transmitted together wirelessly as indicated at 68 to various receivers, one of which resides in one of the new hearing instruments. As illustrated by process 70, the authenticator 54 of the new hearing instrument inputs the received message 62 to the same MAC algorithm 64 as used by the transmitter 60 and uses the same private key to calculate a MAC 72 in the authenticator 54. The authenticator 54 then compares the transmitted MAC 66 to the MAC 72 calculated in the authenticator 54, and If the two MACs are identical, the transmitter 60 of the broadcasted message 62 is authenticated, and so is the message 62, since the private keys and the messages input to the MAC algorithms 64, respectively, have to be identical in order to generate identical MAC codes 66, 72.

The output 56 of the authenticator 54 is used to control the weights of the mixer 32 in response to the result of the authentication process as already explained with reference to FIG. 1.

The authentication process illustrated in principle in FIG. 2 is relatively simple and suitable for implementation in a hearing instrument. The private key has to be distributed to all possible receivers of broadcasted messages from the transmitter in question. Obviously, the distribution of the private key has to be performed with care, since anyone in possession of the private key will be able to generate messages that will be successfully authenticated in the new hearing instruments.

Figure 3:
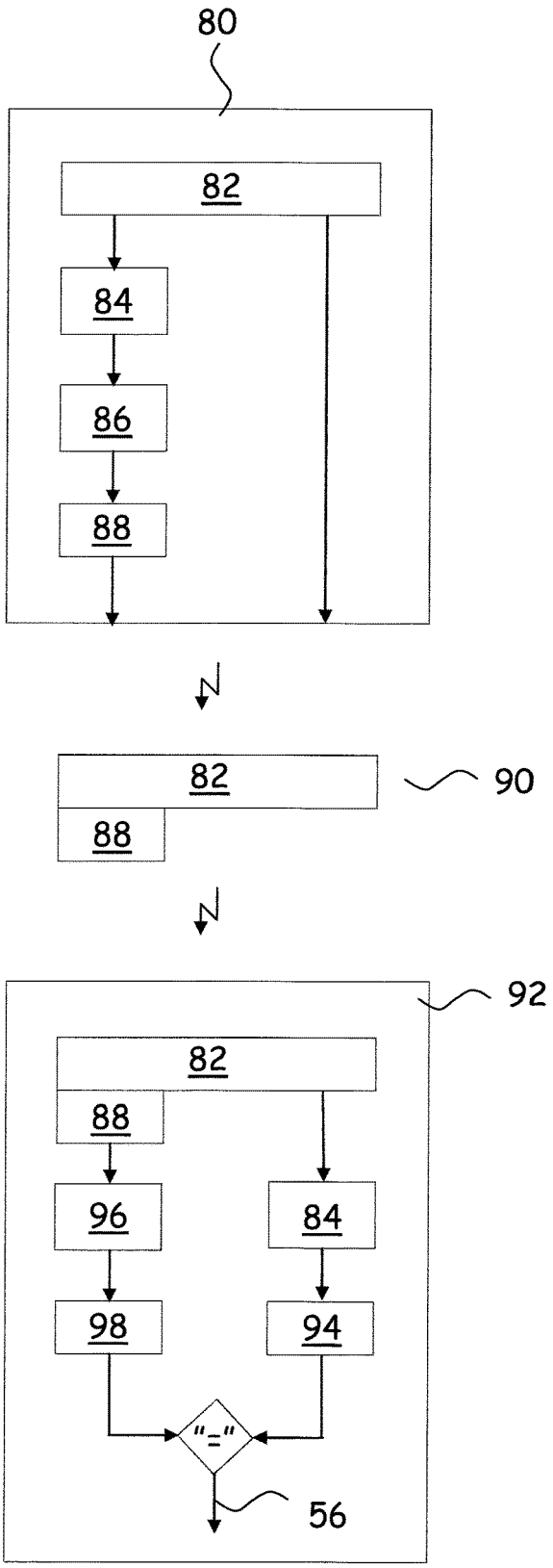

FIG. 3 illustrates another exemplary principle of operation of the authenticator 54 shown in FIG. 1 in which the private key is only in possession of the authentic transmitter.

As in FIG. 2, the transmitter 80 of broadcasted messages 82 may emit aural messages, such as departure announcements in an airport. The broadcasted message 82 is transmitted wirelessly and in digital form to a plurality of receivers. The message 82 is illustrated in digital form in FIG. 3.

In FIG. 3, the message 82 is authenticated using an asymmetric encryption scheme, e.g. a digital signature scheme, with a key pair in which one key is the private key that is in possession of the transmitter 80 to be authenticated. The private key is used to encrypt the message 82 into a digital signature 88. The other key is a public key that is distributed to the intended receivers of messages broadcasted by the transmitter 80 and used to decrypt the digital signature for authentication.

A hashing algorithm 84 calculates a hash code from the digital message 82 and outputs the hash code to an encryption algorithm 86 that uses the private key to encrypt the hash code into a digital signature 88 in order to authenticate the transmitter 80 of the message 82 and thereby reduce the risk of spoofing.

The message 82 and the digital signature 88 are then transmitted together wirelessly as indicated at 90 to various receivers, one of which resides in one of the new hearing instruments. As illustrated by process 92, the authenticator 54 of the new hearing instrument inputs the received message 82 to the same hashing function 84 as used by the transmitter 80 to calculate a hash code 94 in the authenticator 54. Further, the authenticator 54 uses decryption algorithm 96 with the public key to decrypt the digital signature 88 into the hash code 98. The authenticator 54 then compares the hash code 94 with the hash code 98, and if the hash codes 94, 98 are identical, the transmitter 80 of the broadcasted message 82 is authenticated, and so is the message 82, since the private key has to be used in order for the public key to decrypt the digital signature 88 into the correct hash code 98, and the received and transmitted messages have to be identical for the hashing algorithm 84 to output the same hash code. The output 56 of the authenticator 54 is used to control the weights of the mixer 32 in response to the result of the authentication process as already explained with reference to FIG. 1.

The authentication scheme of FIG. 3 is somewhat more complex than the authentication scheme of FIG. 2; however the authentication scheme of FIG. 3 does not require distribution of a private key.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

The invention claimed is:

1. A hearing instrument comprising:

a hearing loss processing unit;

a radio configured to receive an audio message from a source;

an authenticator coupled to the hearing loss processing unit; and a receiver configured for converting the audio message into an acoustic signal for transmission towards an eardrum of a user of the hearing instrument;

wherein the radio is configured to receive an additional audio message from the source, and wherein the authenticator is configured to individually authenticate the audio message and the additional audio message by performing multiple authentications respectively for the audio message and the additional message.

2. The hearing instrument according to claim 1, wherein the hearing instrument is further configured for muting at least one other signal received by the hearing instrument upon successful authentication of the audio message.

3. The hearing instrument according to claim 1, further comprising a mixer configured for mixing the audio message with at least one other signal received by the hearing instrument to obtain a mixed output upon successful authentication of the audio message, wherein the receiver is configured for converting the mixed output into the acoustic signal for transmission towards the eardrum of the user of the hearing instrument.

4. The hearing instrument according to claim 1, wherein the hearing instrument is further configured for ignoring the audio message upon failed authentication of the audio message.

5. The hearing instrument according to claim 1, further comprising a mixer configured for mixing the audio message and the additional audio message to obtain a mixed output upon successful authentication of the audio message and the additional audio message, wherein the audio message and the additional audio message are received simultaneously by the hearing instrument, and wherein the receiver is configured for converting the mixed output into the acoustic signal for transmission towards the eardrum of the user of the hearing instrument.

6. The hearing instrument according to claim 1, wherein the additional audio message that is received during transmission of the acoustic signal towards the eardrum of the user of the hearing instrument, and wherein the hearing instrument further comprises a medium configured to store the additional audio message.

7. The hearing instrument according to claim 6, wherein the receiver is configured for converting the stored additional audio message into another acoustic signal for transmission towards the eardrum of the user of the hearing instrument.

8. The hearing instrument according to claim 7, wherein the audio message and the additional audio message are converted into the respective acoustic signals for transmission towards the eardrum of the user of the hearing instrument in an order in which they are received by the hearing instrument.

9. The hearing instrument according to claim 7, wherein the audio message and the additional audio message are converted into the respective acoustic signals for transmission towards the eardrum of the user of the hearing instrument in an order of priority.

10. The hearing instrument according to claim 1, wherein the authenticator is configured for verifying an electronic signature included in the audio message.

11. The hearing instrument according to claim 1, wherein the authenticator is configured for decrypting an encrypted message included in the audio message for authentication of the audio message.

12. The hearing instrument according to claim 1, wherein the authenticator is configured for decoding a hash code included in the audio message.

13. The hearing instrument according to claim 1, further comprising a mixer, wherein the authenticator is coupled indirectly to the hearing loss processing unit via the mixer.

14. The hearing instrument of claim 1, wherein the audio message comprises at least a part of a public announcement.

15. The hearing instrument of claim 1, wherein the multiple authentications comprise multiple message-based authentications.

16. A method performed by a hearing instrument, comprising:

receiving, by the hearing instrument, an audio message and a signature from a source, wherein the signature identifies a transmitter of the audio message, the hearing instrument comprising a hearing loss processing unit;

authenticating, using an authenticator, the audio message based on the signature, the authenticator coupled to the hearing loss processing unit; and converting the audio message into an acoustic signal for transmission towards an eardrum of a human;

wherein the method further comprises receiving an additional audio message from the source, and authenticating the additional message;

wherein the audio message and the additional audio message are individually authenticated by the authenticator performing multiple authentications respectively for the audio message and the additional message.

17. The method according to claim 16, wherein the signature is encrypted when received by the hearing instrument, and the act of authenticating comprises decrypting the encrypted signature.

18. The method according to claim 16, wherein the authenticator is coupled indirectly to the hearing loss processing unit via a mixer.

19. The method of claim 16, wherein the audio message comprises at least a part of a public announcement.

20. The method of claim 16, wherein the multiple authentications comprise multiple message-based authentications.

21. A system comprising:

a transmitter configured for transmitting an audio message and an additional audio message, the transmitter comprising an encoder configured for encoding a signature identifying the transmitter for transmission together with message to be transmitted, and a hearing instrument comprising:

a hearing loss processing unit;

a radio for reception of the audio message and the additional audio message, and an authenticator coupled to the hearing loss processing unit, wherein the hearing instrument is configured for converting the audio message into an acoustic signal for transmission towards an eardrum of a user of the hearing instrument; and wherein the authenticator is configured to individually authenticate the audio message and the additional audio message by performing multiple authentications respectively for the audio message and the additional message.

22. The system according to claim 21, wherein the authenticator is coupled indirectly to the hearing loss processing unit via a mixer.

23. The system of claim 21, wherein the audio message comprises at least a part of a public announcement.

24. The system of claim 21, wherein the multiple authentications comprise multiple message-based authentications.

25. A hearing instrument comprising:

a hearing loss processing unit;

a radio for reception of messages from one or more sources;

an authenticator coupled to the hearing loss processing unit; and a receiver configured for converting at least one of the messages into an acoustic signal for transmission towards an eardrum of a user of the hearing instrument;

wherein the authenticator is configured to perform multiple authentications respectively for the messages.

26. The hearing instrument of claim 25, wherein the at least one of the messages comprises at least a part of a public announcement.

27. The hearing instrument of claim 25, wherein the authenticator is configured to verify an electronic signature in the at least one of the messages.

28. The hearing instrument of claim 25, wherein the authenticator is configured to perform message-based authentication such that the messages received by the hearing instrument are individually processed for authentication.

29. A hearing instrument comprising:

a hearing loss processing unit;

a radio for reception of messages from one or more sources;

an authenticator coupled to the hearing loss processing unit; and a receiver configured for converting at least one of the messages into an acoustic signal for transmission towards an eardrum of a user of the hearing instrument;

wherein the authenticator is configured to individually process the messages received by the hearing instrument for multiple authentications of the respective messages.

30. The hearing instrument of claim 29, wherein the at least one of the messages comprises at least a part of a public announcement.

31. The hearing instrument of claim 29, wherein the authenticator is configured to verify an electronic signature in the at least one of the messages.

32. The hearing instrument of claim 29, wherein the authenticator is configured to perform multiple authentications respectively for the messages based on signatures in the respective messages.

* * * * *